US007520109B2

(12) United States Patent
Fitzsimmons et al.

(10) Patent No.: US 7,520,109 B2
(45) Date of Patent: Apr. 21, 2009

(54) RECONFIGURABLE MAILING SYSTEM HAVING INTERCHANGEABLE MAILPIECE SEALING AND OPENING MODULES

(75) Inventors: Thomas W. Fitzsimmons, New Milford, CT (US); Walter J. Kulpa, Trumbull, CT (US); Richard D. Boughton, Newtown, CT (US); Ralph A. Rapillo, Trumbull, CT (US)

(73) Assignee: Pitney Bowes Inc., Stamford, CT (US)

( * ) Notice: Subject to any disclaimer, the term of this patent is extended or adjusted under 35 U.S.C. 154(b) by 71 days.

(21) Appl. No.: 11/784,744

(22) Filed: Apr. 9, 2007

(65) Prior Publication Data

US 2008/0249963 A1 Oct. 9, 2008

(51) Int. Cl.
*B43M 5/04* (2006.01)
*B43M 7/00* (2006.01)

(52) U.S. Cl. ..... 53/492; 53/381.3; 53/381.7; 156/441.5; 156/442.1; 156/442.2

(58) Field of Classification Search ..... 53/492, 53/381.3, 381.7; 156/441.5, 442.2, 442.1; *B43M 5/04, B43M 7/00*

See application file for complete search history.

(56) References Cited

U.S. PATENT DOCUMENTS 1,317,517 A * 9/1919 McMillan ..... 156/442.1
2,106,191 A * 1/1938 Ryan ..... 83/399
3,015,926 A * 1/1962 Galambos ..... 53/201
4,371,416 A * 2/1983 Denzin ..... 156/441.5
5,022,953 A * 6/1991 Fassman et al. ..... 156/441.5
5,338,387 A * 8/1994 Noll ..... 156/441.5
5,628,864 A * 5/1997 Kataigi et al. ..... 156/441.5
6,406,591 B1 * 6/2002 Beckstrom et al. ..... 156/441.5

* cited by examiner

*Primary Examiner*—Stephen F Gerrity
(74) *Attorney, Agent, or Firm*—Brian A. Collins; Angelo N. Chaclas

(57) ABSTRACT

A mailing machine is provided for processing mailpiece envelopes including a housing having a transport deck adapted to convey an envelope along a feed path and a receiving station. The mailing machine is reconfigurable to perform one of two mailpiece processing operations by alternately selecting or activating one of two mailpiece modules/assemblies. A first processing module/assembly is disposed along the feed path and is operative to moisten a glue line disposed along an envelope flap during the first mailpiece processing operation. The second processing module assembly is disposed along the feed path and is adapted to cut and open an edge of the envelope during the second mailpiece processing operation. Further, a mechanism for interchangeably receiving one of the first and second the processing modules/assemblies within the receiving station to perform the processing operations.

16 Claims, 6 Drawing Sheets

RECONFIGURABLE MAILING SYSTEM HAVING INTERCHANGEABLE MAILPIECE SEALING AND OPENING MODULES

FIELD OF THE INVENTION

The invention disclosed herein relates generally to mailing systems, and more particularly to a system and method for reconfiguring a mailing machine for closing and opening a mailpiece envelope.

BACKGROUND OF THE INVENTION

Mailing systems, such as, for example, a mailing machine, often include a variety of modules to automate processes associated with producing a mailpiece. Other systems, such as, for example, a mailpiece opener, are dedicated to a single operation, such as opening a sealed envelope. Whether automating a single or several operations, these mailing systems typically serve to improve efficiency by minimizing the labor associated with filling/inserting or removing content material from an envelope.

A typical mailing machine includes a variety of different modules or sub-systems each of which performs different tasks. The mail piece is conveyed downstream utilizing a transport mechanism, such as rollers or a belt, to each of the modules. Such modules include, inter alia, a moistening/sealing module, i.e., wetting and sealing the glued flap of an envelope. The moistening/sealing module/assembly typically includes a structure for deflecting a flap of a moving envelope away from the envelope's body to enable the moistening and sealing process to occur. The deflecting structure typically includes a blade that becomes interposed between the flap and the body of the envelope, i.e., to separate the flap from the body, as the envelope traverses the transport deck. Once the flap has been separated, the moistener wets the glue line on the flap in preparation for sealing the envelope. One type of moistening system, known as a contact moistening system, deposits a moistening fluid, such as, for example, water or water with a biocide, onto the glue line of the flap by contacting the glue line with a wetted applicator.

A mailpiece opener, on the other hand, may include dedicated cutting blades disposed proximal to a registration wall which guides the mailpiece past the cutting blades. The cutting blades are typically enclosed in a channel and protrude from a top and bottom surface of the opener. As the mailpiece is fed to the channel, angled conveyor nips drive the mailpiece against the registration wall and through the cutting blades. The cutting blades remove a thin strip of material along the top edge of the mailpiece envelope and, as such, open the mailpiece to expose the mailpiece content material.

Inasmuch as the moistening/sealing module/assembly of a mailing machine is necessarily at cross purposes with the cutting/opening blades of a mailpiece opener, it will be appreciated that these modules remain separate i.e., are not integrated in a single device. That is, inasmuch as one module/assembly closes and the other opens, it has been common practice to offer the moistener/sealing module/assembly on machines which fabricate mailpieces and the cutting blades on machines which open mailpieces. As such, mail service providers must invest, maintain and incur the cost of two separate machines.

A need, therefore, exists for a mailing machine which is reconfigurable for moistening/sealing the envelope flap to close the envelope and for cutting an edge of the mailpiece to open the envelope.

SUMMARY OF THE INVENTION

A mailing machine is provided for processing mailpiece envelopes, including a housing having a transport deck adapted to convey an envelope along a feed path. The mailing machine is reconfigurable to perform one of two mailpiece processing operations by alternately selecting or activating one of two mailpiece modules/assemblies. A first processing module/assembly is disposed along the feed path and is operative to moisten a glue line disposed along an envelope flap during the first mailpiece processing operation. The second processing module assembly is disposed along the feed path and is adapted to cut and open an edge of the envelope during the second mailpiece processing operation. Further, a means is provided for selecting one of the first and second of the processing modules/assemblies to perform the processing operations.

DESCRIPTION OF THE DRAWINGS

The accompanying drawings illustrate presently preferred embodiments of the invention, and together with the general description given above and the detailed description given below, serve to explain the principles of the invention. As shown throughout the drawings, like reference numerals designate like or corresponding parts.

DETAILED DESCRIPTION OF THE PRESENT INVENTION

The present invention will be described in the context of a mailing machine having many independent modules/assemblies including, for example, singulating, printing, weighing and metering modules. It should be appreciated that these modules/assemblies may or may not be integrated in the same manner as shown or described or in the same sequence of operation. At minimum, however, the invention contemplates at least two modules/assemblies, which are adapted to (i) seal/close seal a mailpiece envelope and (ii) cut/open the mailpiece envelope. Furthermore, these modules/assemblies may be integrated within the housing of the mailing machine or may be interchangeable i.e., may not be integrated simultaneously.

Glue Moistening Module/Assembly

Figure 1:
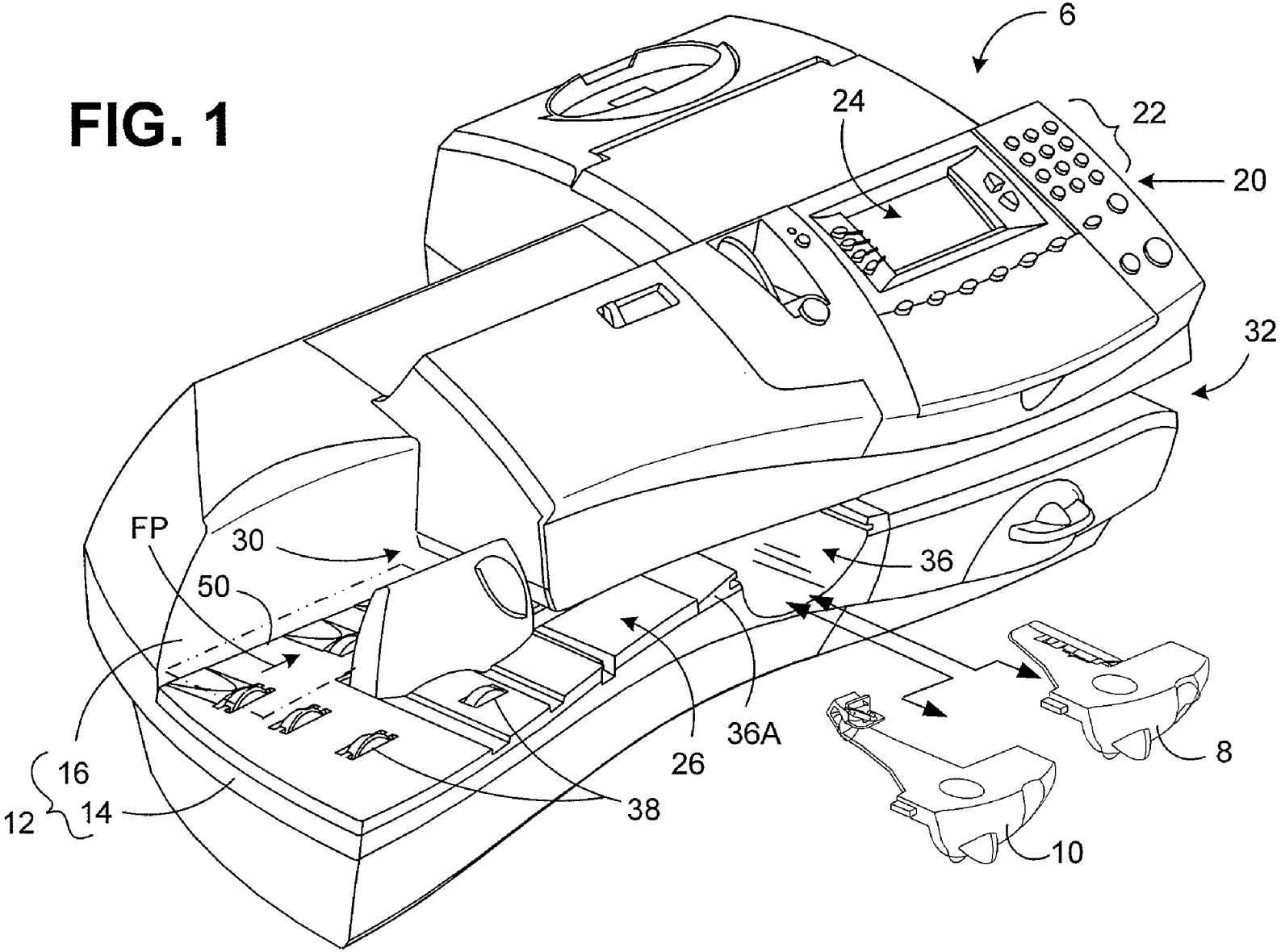
FIG. 1 is a perspective view of a reconfigurable mailing machine according to one embodiment of the present invention wherein a center moistening/sealing module/assembly is interchangeable with a cutter/opening module/assembly.

In describing the present invention, reference is made to the drawings, wherein there is seen in FIG. 1 a reconfigurable mailing machine 6 according to one embodiment of the present invention includes interchangeable processing modules/assemblies 8, 10. The mailing machine 6 comprises a housing 12 including a base designated generally by the reference numeral 14 and a registration wall 16. A control unit 20 is mounted on the housing 12, and includes one or more input/output devices, such as, for example, a keyboard 22 and a display device 24.

The base 14 further includes a horizontal feed or transport deck 26 for feeding mailpieces in succession along a feed path FP from an input end 30 to an output end 32 of the deck 26. The base also includes a receiving station 36 disposed along the transport deck 26 and substantially parallel thereto. A plurality of rollers 38 are suitably mounted under the transport deck 26 and project upwardly through openings therein so that the periphery of the rollers 38 extends slightly above the upper surface of the feed deck 30 so as to provide a forward feeding force on a succession of mailpieces placed in the input end 30. The registration wall 16 defines a mail piece registration surface which is substantially perpendicular to the transport deck 26 and which extends substantially from the input end 30 to the output end 32 of the transport deck 26.

Mailpieces 50 (shown in phantom lines in FIG. 1) placed in the input end 30 are fed by the rollers 38 along the transport deck 26, with a top edge of the mailpiece being disposed against the registration wall 16. The mailpieces 50 are fed along the feed path FP past the receiving station 36 where one of two mailpiece processing operations are performed. While each processing operation will be discussed in greater detail in subsequent paragraphs, a first mailpiece processing operation is associated with moistening a glue line (i.e., along the envelope flap) for sealing the flap against the envelope body and a second mailpiece processing operation is associated with cutting an edge (e.g., generally the top edge) of the mailpiece to open the envelope for removing the enclosed content material.

Figure 2:
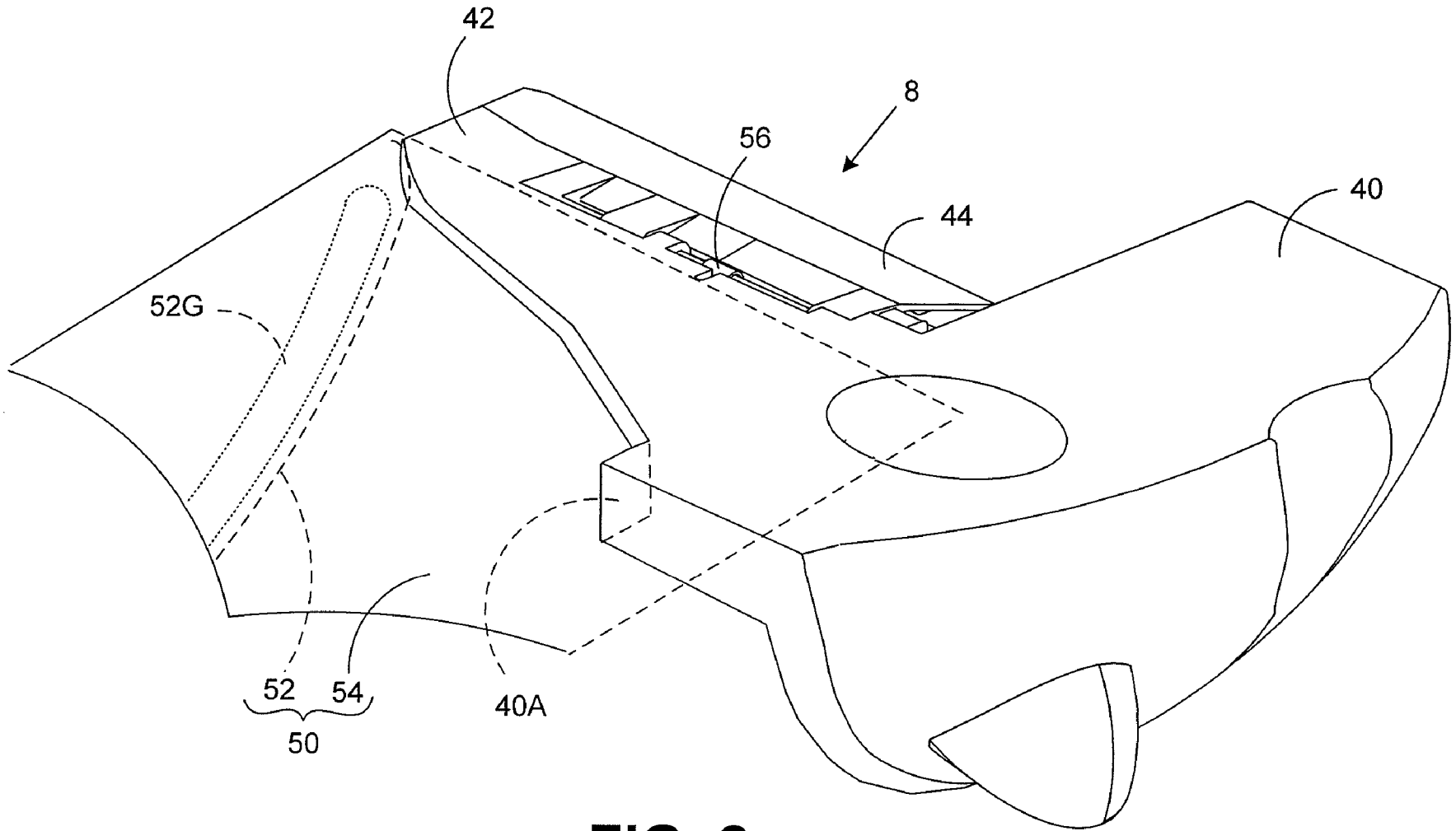
FIG. 2 is isolated perspective view of the moistening/sealing module/assembly.

In FIGS. 1 and 2, the first or glue moistening module/assembly 8 is adapted to moisten the glue line of the mailpiece envelope 50 for subsequent sealing In this and subsequent paragraphs, the terms "mailpiece", "mailpiece envelope" and "envelope" will be used interchangeably inasmuch as the invention relates to the processing of mailpieces, i.e., as such processes relate to the closing and opening the mailpiece envelope. The glue moistening module/assembly 8 (also referred to as the "moistening module") includes a body portion 40 including a stripping blade 42, a spring-biased moistening applicator 44, a reservoir containing a moistening liquid and a wick. The reservoir and wick are not visible in FIG. 2 inasmuch as the blade 42 and applicator 44 is disposed over and covers both the reservoir and the wick. The body portion 40 is accepted within the receiving station 36 (FIG. 1) of the housing 12 and includes at least one alignment surface 40A for abutting with a mating surface 36A of the receiving station 36. The receiving station 36 and body portion 40 may include any one of a variety of interlocking or sliding interfaces such as a latch key, track, channel or guide to align and mate the moistening module/assembly 8 within the housing 12. Furthermore, the interlocking or sliding interface may be adapted with quick connect/disconnect features to allow the moistening and opening modules/assemblies 8, 10 to be interchangeable within the receiving station 36.

In operation, the moistening module/assembly 8 is positioned such that the stripping blade 42 interposes the envelope flap 52 and the envelope body 54 as the envelope 50 traverses the transport deck 26. More specifically, the envelope 50 is situated on the transport deck 26 face up, i.e., with the envelope flap 52 facing the transport deck 26 As the envelope 50 is conveyed along the transport deck 26, it is guided past the module/assembly 8 such that the flap 52 passes below the stripper blade 42 while the body 54 passes above the stripper blade 42. Thus, the envelope flap 52 is "stripped" from the envelope body 54 by the stripper blade 42.

After being separated by the stripper blade 42, the envelope flap 52 passes the moistening applicator 44 which is pivotally mounted to the blade 42 and spring-biased downwardly toward the flap 52 by a torsion spring 56. More specifically, the moistening applicator 44 includes a contact media, such as, for example, a brush, foam or felt pad. The contact media of the applicator 44 is located above and in contact with the wick (not shown) which is preferably composed from a woven material having one end thereof disposed in the reservoir. As such, the wick draws the moistening fluid to the contact media which, in turn, moistens the glue line 52G of the flap 52. That is, before the envelope 50 passes the moistening module/assembly 8, the moistening fluid is transferred to the contact media of the applicator 44, i.e., absorbing the moistening fluid from the wick. As the envelope flap 52 passes under the blade 42 and applicator 44, the contact media is urged downwardly, i.e., by the torsion spring 56, against the glue line 52G of the envelope flap 52. Accordingly, the envelope flap 52 may be sealed against the envelope body 54. This step is typically performed downstream of the moistening module/assembly 8 by a plurality of sealing rollers (not shown) which apply pressure to the glue line.

Cutting/Envelope Opening Module/Assembly

Figure 3:
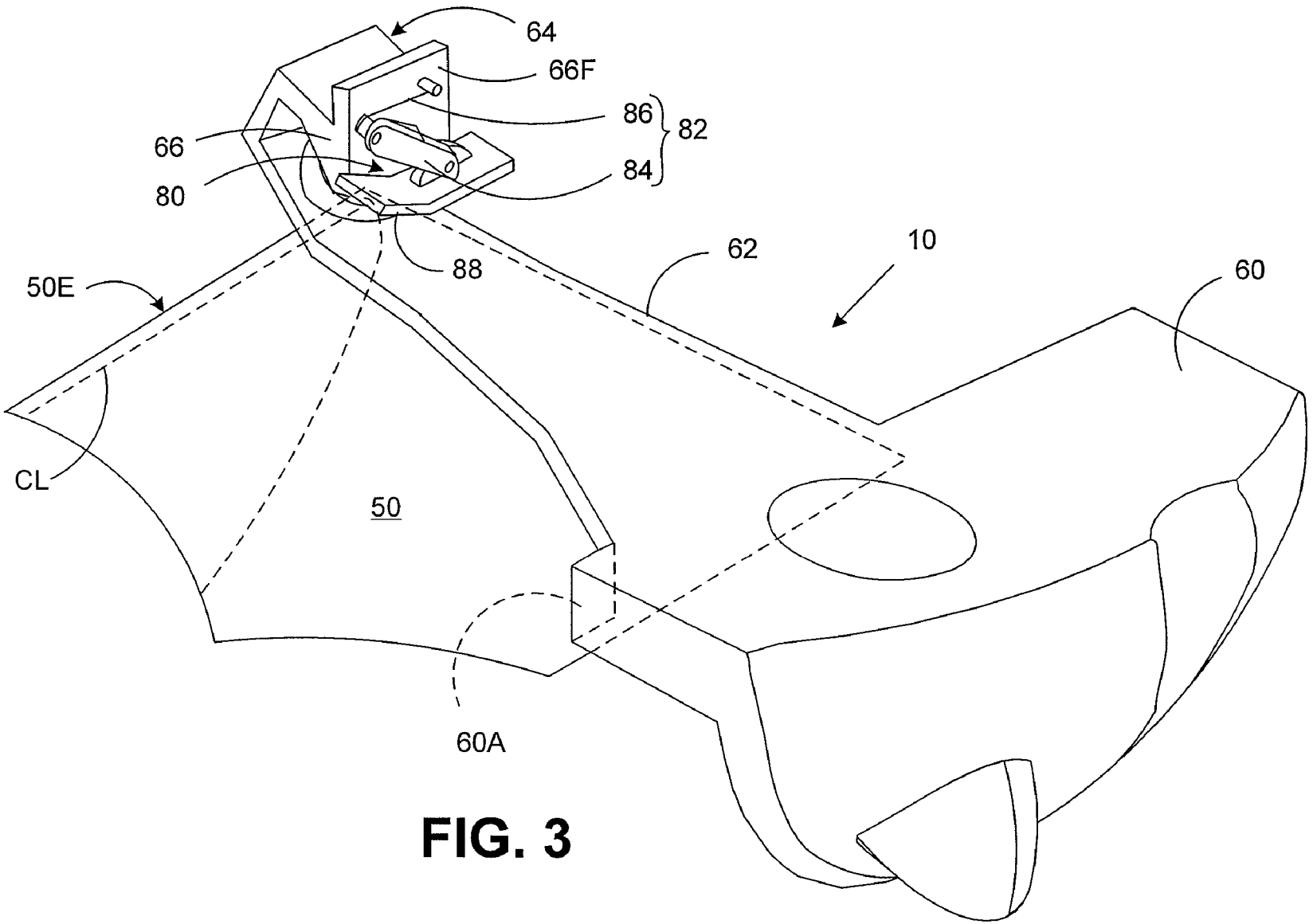
FIG. 3 is isolated perspective view of the cutting/opening module/assembly.

In FIGS. 1 and 3, a second or envelope opening module/assembly 10 is operative to cut an edge 50E of the mailpiece envelope 50 for subsequent removal of the mailpiece contents. Similar to the moistening module/assembly 8, the envelope opening module/assembly 10 (also referred to as the "opening module") includes a center body 60 adapted to be accepted within the receiving station 36 of the housing 12. The center body 60 includes at least one alignment surface 60A for abutting with the mating surface 36A of the receiving station 36. The receiving station 36 and center body 60 may also include a conventional interlocking or sliding interface such as a track, channel or guide to align and mate the opening module/assembly moistening module/assembly 8 within the housing 12. As mentioned earlier, the interlocking or sliding interface may be adapted with quick connect/disconnect features to allow for interchangeability of the modules/assemblies 8, 10.

Figure 4:
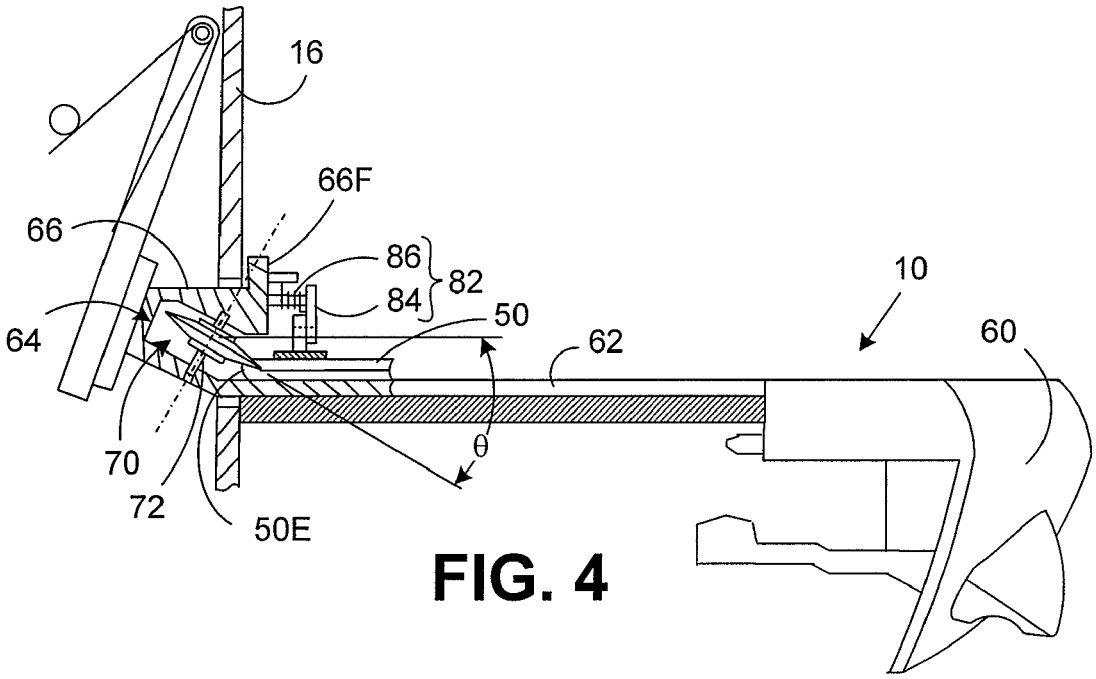
FIG. 4 is a view taken substantially along line 4-4 of FIG. 1 illustrating the cutting blade/opening module/assembly, including a cutting blade disposed within a tip end housing and a deflection plate.
Figure 5:
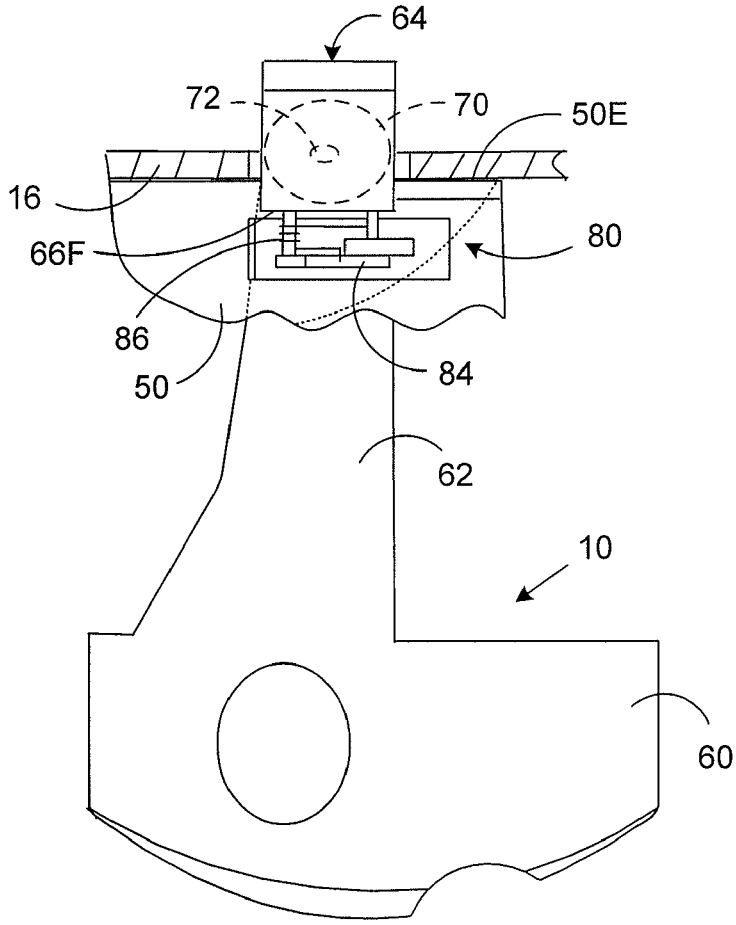
FIG. 5 is a top view of the cutting/opening module/assembly depicted in FIG. 4.

In FIGS. 3, 4 and 5, the opening module/assembly 10 also includes a structural arm 62 extending from the center body 60 and a tip end portion 64 integral with the structural arm 62. The tip end portion 64 extends upwardly and backwardly, i.e., is re-curved, toward the center body 60 to define a C-shaped support structure 66. A disc-shaped cutting blade 70 is supported on a axle 72 and is mounted within the C-shaped support structure 66. More specifically, each end of the axle 72 is affixed internally of the support structure 66 so as to mount the cutting blade 70 on an axis which is tilted relative to the vertical. Inasmuch as the circular cutting blade 70 is orthogonal to the axis, the blade 70 defines a downwardly sloping angle θ. In the described embodiment, the cutting blade 70 defines an angle θ of between about forty (40) to about sixty (60) degrees relative to a horizontal plane defined by the envelope 50 or the transport deck 26. Though, it should be appreciated that the cutting blade 70 may assume any angle between about zero (0) degrees to about ninety (90) degrees relative to the horizontal transport deck 26.

Additionally, the opening module/assembly 10 may include a deflection plate 80 to ensure or maintain vertical alignment of the envelope 50 with the cutting blade 70. More specifically, the deflection plate 80 may be mounted proximal to the tip end 64 of the opening module/assembly 10 to guide and maintain the vertical position of the envelope as it traverses into and past the cutting blade 70. The deflection plate 80 is preferably mounted in close proximity to the cutting blade 70 to improve its performance and efficiency. In the described embodiment, the deflection plate is mounted to a face surface 66F of the C-shaped support structure 66 so as to contact and guide the envelope 50 immediately outboard of the cut line CL of the blade 70. Furthermore, to accommodate changes in envelope thickness, the deflection plate 80 may include a suspension mounting assembly 82, e.g., a lever arm 84 which is spring biased downwardly by a torsion spring 86, and include a curved leading edge 88 (best seen in FIG. 3) to facilitate even more abrupt thickness variations.

In operation, the opening module/assembly 10 is positioned such that the cutting blade 70 is disposed outboard of a peripheral edge of the envelope 50. With respect to the majority of mailing machines 6, the cutting blade 70 will necessarily be disposed outboard of the top edge of the envelope 50. Similar to the first processing operation associated with the moistening module/assembly 8, the envelope 50 is guided along the transport deck 26 by the registration wall 16 during the second processing operation associated with the opening module/assembly 10. In FIGS. 4 and 5, as the top edge 50E of the envelope 50 traverses the cutting blade 70, the blade 70 cuts through at least one layer, or sheet thereof, to open the envelope. Preferably, the cutting blade 70 does not cut through two layers or through the entire envelope thickness to avoid the production of scrap or waste material which must be retained/captured and discarded. Furthermore, the deflector plate 80 guides the top edge 50E of the envelope 50 through the tip end 64 of the opening module/assembly 10 to improve the cutting efficacy of the blade 70.

The mailing machine 6 of the present invention performs both mailpiece processing operations, i.e., a moistening/sealing operation and a cutting/opening operation, by adapting the housing to accept interchangeable modules. In the described mailing machine 6, a registration wall 16 is employed to guide envelopes along the feed path. However, to enable operation of the opening module/assembly 10 in place of the moistening module/assembly 8, a modification to the registration wall 16 is required to suitably position the cutting blade 70 relative to the top edge 50E of the envelope 50. More specifically, the registration wall 16 may include a small opening, aperture, break or other discontinuity therein to accommodate insertion of the cutting blade and/or the spatial relationship of the cutting blade 70 relative to the top edge 50E of the envelope.

Figure 6:
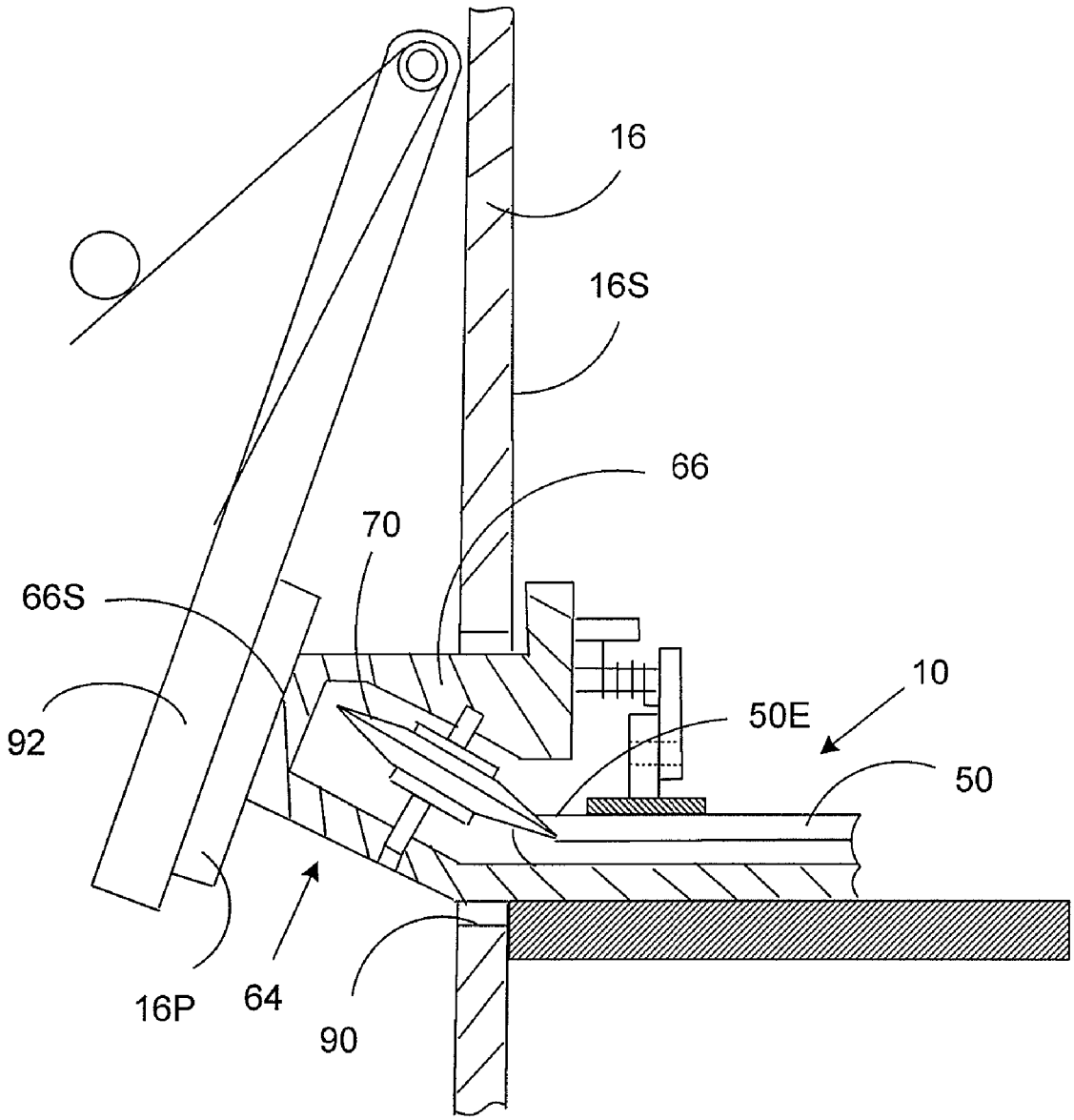
FIG. 6 is an enlarged view of the tip end portion of the cutting/opening module/assembly as the tip end portion extends through an opening within a registration wall of the mailing machine.

Referring to FIGS. 1 and 6, the registration wall 16 may include a receiving aperture 90 which is substantially aligned with the receiving station 26 of the base 14. Inasmuch as paper dust and paper fiber can produce significant mechanical and electrical problems for mailing machines, i.e., any apertures or openings formed in the housing 12, should be of a minimum size and, preferably, should be closed or covered whenever possible. To prevent paper fibers and/or dust particles from being ingested or to avoid the skewing of a mailpiece when passing the aperture 90, the registration wall 16 may include an access door or flap which is spring-activated to a closed position. In the described embodiment, the access door 92 is pivot mounted to a back-side surface 16B of the registration wall. Furthermore, the access door 92 includes a filler plug 16P for maintaining a flush contour with the registration surface 16S of the wall 16 and includes a torsion spring 94 to bias the door 92 and filler plug 16P into and against aperture opening 90.

When the opening module/assembly 10 engages the receiving station 26 (FIG. 1), an external surface 66S of the tip end portion 64, i.e., C-shaped cutting blade support structure 66, abuts the filler plug 16P to open the door 92. When the opening module/assembly 10 is removed, the door and filler plug 92, 16P close and fill the aperture opening 90. Consequently, the moistening module/assembly 8 may be interchanged therefore and is provided a smooth, substantially continuous registration surface for guiding mailpieces 50.

Figure 7:
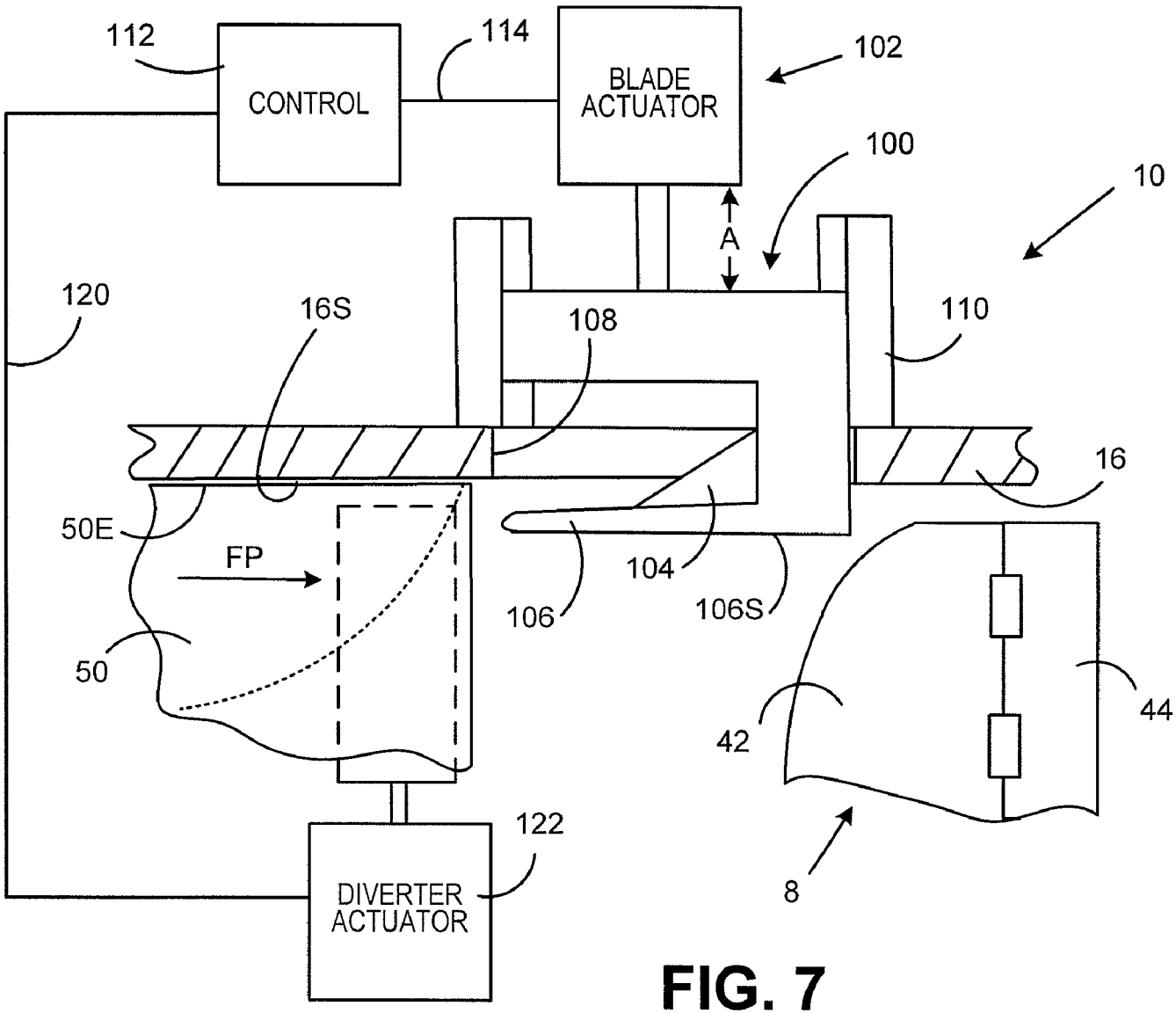
FIG. 7 depicts an alternate embodiment of the reconfigurable mailing machine having a cutting/opening module/assembly, including a cutting blade/blade guide which: (i) retracts into a recess of the registration wall when the moistening sealing module/assembly is active and (ii) extends into the envelope feed path when the cutting/opening module/assembly is active.

In an alternate embodiment of the invention, shown in FIGS. 1 and 7, the housing 12 of the mailing machine 6 is adapted to perform both mailpiece processing operations, i.e., closing and opening the envelope 50. In this embodiment, the mailpiece processing assemblies are not necessarily modular, though, one of the assemblies may be removable for maintenance or other purposes. Therein, the mailpiece processing operation associated with moistening the glue line, i.e., the use of a stripper blade 42 and moistening applicator 44, is essentially the same structure as previously described. Though, the modular requirement for a receiving station is no longer needed and the moistening assembly 8 may remain undisturbed even when reconfiguring the mailing machine 6 for cutting/opening operations.

The cutting/opening assembly 10 includes a blade assembly 100 and an actuator 102 for extending and retracting the blade assembly 100 relative to the registration wall 16 of the housing 12, i.e., in the direction of arrow A (FIG. 7). The blade assembly 100 includes a cutting blade 104 and a cutting guide 106 disposed within and through an opening/recess 108 in the registration wall 16. Furthermore, the blade assembly 100 includes a linear guide or track assembly 110 for guiding the blade assembly 100 through the registration wall as the actuator 102 extends and retracts the blade assembly 100.

In operation, a controller 112 issues a signal 114 to the actuator 102 to extend the cutting blade assembly 100 into the feed path of the mailpiece 50. Prior to extension, the blade assembly 100 is retracted into the opening 108 of the registration wall 16 such that an exterior surface 106S of the cutting guide 106 is flush with the registration surface 16S of the wall 16. At generally the same time, a signal 120 is sent to a diverter assembly 122 which diverts the path of the envelope 50 from the moistening assembly 8 to the cutting blade assembly 100. Diverter assemblies 122 of this type are well known in the art and will not be described in greater detail herein. Suffice to say that the diverter assembly 122 changes the envelope path, typically in a manner which raises the envelope 50 over and/or past the moistener assembly 8.

As the envelope 50 approaches tile culling guide 106, a flap buckling mechanism (not shown) may be employed to produce a small opening or gap between the sealed envelope flap and the envelope body. Thereafter, the envelope 50 engages the guide 106, i.e., through the opening, and passes cuffing blade 104. The cuffing guide 106. therefore, guides the cuffing blade 104 along the top edge 50E to open the envelope 50. In this embodiment, therefore, a means is provided for selecting one of the first and second of the processing assemblies, i.e., either the moistening assembly 8 or the cutting/opening assembly 10 to perform one of the processing operations.

While the invention has been described in the context of a housing having a receiving station 26 for accepting interchangeable modules/assemblies 8, 10 or a mailing machine having dedicated processing stations to perform processing operations, the present invention may also be described in the context of an inventive method. In the broadest sense thereof, the method includes the steps of: (i) activating one of the processing modules/assemblies to perform one of the processing operations, i.e., processing operations associated with closing and opening a mailpiece envelope, (ii) deactivating the active processing module/assembly; and (iii) activating the other of the processing modules/assemblies to perform the other of the processing operations.

In summary, the invention provides a mailing machine having interchangeable modules or dedicated processing stations to (i) selectively moisten a mailpiece envelope for the purposes of sealing, or (ii) cut the top edge of an envelope for the purposes of removing its internal contents. The mailing machine performs these operations without producing scrap/loose material which must be captured and removed. Furthermore, the invention provides for minimal impact to existing mailing machine structure, e.g., an opening/aperture within the registration wall or linearly activated blade assembly to permit cutting along the top edge of the mailpiece envelope.

While preferred embodiments of the invention have been described and illustrated above, it should be understood that these are exemplary of the invention and are not to be considered as limiting. Additions, deletions, substitutions, and other modifications can be made without departing from the spirit or scope of the present invention. Accordingly, the invention is not to be considered as limited by the foregoing description but is only limited by the scope of the appended claims.

What is claimed is:

1. In a mailing machine having a housing, a method for processing a mailpiece comprising the steps of:

activating one of a first and second processing modules/assemblies to perform one of first and second processing operations;

the first processing operation associated with moistening a glue line of an envelope flap, and the second processing operation associated with cutting an edge of an envelope to open the mailpiece;

deactivating the active processing module/assembly; and activating the other of the first and second processing modules/assemblies to perform the other of the first and second processing operations by interchangeably installing one of the first and second processing modules/assemblies into a receiving station of the housing to perform one of the first and second processing operations and removing one of the first and second processing modules from the receiving station to perform one of the first and second processing operations.

2. The method according to claim 1 wherein the mailing machine includes a registration wall having an opening therein, and wherein the step of activating one of the first and second processing modules/assemblies includes linearly extending and retracting a cutting blade assembly through the registration wall to perform the second processing operation associated with cutting an edge of an envelope to open the mailpiece.

3. The method according to claim 2:

wherein the first processing module/assembly is a moistening assembly operative to perform the first processing operation wherein the second processing module/assembly is a cutting assembly operative to perform the second processing operation and further comprising the step of:

diverting the mailpiece envelope over the first processing module/assembly to direct the mailpiece to the second processing module/assembly during the second processing operation.

4. The method according to claim 1 further comprising the steps of:

installing one of a first and second processing modules/assemblies in the receiving station of the housing to perform one of a first and second processing operations;

removing the processing module/assembly from the receiving station; and, installing the other of the first and second processing modules/assemblies in the receiving station of the housing to perform the other of the first and second processing operations.

5. The method according to claim 1 wherein the receiving station is adapted to accept either of the first and second processing modules/assemblies.

6. The method according to claim 1 wherein the housing includes a registration wall having an opening therein, wherein the second processing assembly includes a tip end portion for mounting a cutting blade, and wherein the step of installing one of the processing assemblies into the receiving station includes the step of installing the tip end portion of the second processing assembly through the registration wall to perform the second mailpiece processing operation.

7. A mailing machine for processing mailpiece envelopes, comprising:

a housing having a transport deck adapted to convey an envelope along a feed path and including a housing having a receiving station, a first processing module/assembly disposed along the feed path and operative to moisten a glue line disposed along an envelope flap during a first mailpiece processing operation;

a second processing module/assembly disposed along the feed path and operative to cut and open an edge of the envelope during a second mailpiece processing operation; and, a means for alternately selecting one of the first and second processing modules/assemblies to perform one of the first and second processing operations and interchangeably receiving one of the first and second processing modules/assemblies within the receiving station to perform the respective processing operation.

8. The mailing machine according to claim 7 wherein the second processing module/assembly includes a center body, a structural arm extending from the center body, and a disc-shaped cutting blade, the structural arm having an integral tip end portion defining a C-shaped support structure for mounting the cutting blade.

9. The mailing machine according to claim 8 wherein the housing includes a registration wall having an opening therein, and wherein the tip end portion of the second processing module/assembly extends through the opening to cut a top edge of the mailpiece envelope.

10. The mailing machine according to claim 9 further comprising an access door mounted to a back-side surface of the registration wall, the access door including a filler plug which extends into and fills the registration wall opening, the filler plug, furthermore, maintaining a flush contour with a registration surface of the registration wall.

11. The mailing machine according to claim 10 wherein the tip end portion engages and opens the access door when being accepted within the receiving station of the housing.

12. The mailing machine according to claim 10 further including a spring to bias the access door and filler plug into and against the registration wall opening.

13. The mailing machine according to claim 8 wherein the envelope defines a envelope thickness of at least two sheets and wherein the cutting blade is disposed on an angle relative to the envelope to cut through at least one sheet of the envelope thickness.

14. The mailing machine according to claim 13 wherein the angle of the cutting blade is between about forty (40) to about sixty (60) degrees relative to the plane of the mailpiece envelope.

15. The mailing machine according to claim 7 wherein the housing includes a registration wall, wherein the first processing module/assembly includes a moistening module/assembly having a stripping blade and a moistening applicator pivotally mounted to the stripping blade, the stripping blade operative to separate the envelope flap from the mailpiece envelope and the moistening applicator operative to wet the glue line with a moistening liquid, wherein the second processing module/assembly includes a cutting blade assembly operative to extend and retract relative to the registration wall, the cutting blade assembly, furthermore, retracted into a recess of the registration wall during the first mailpiece processing operation and extending into the feed path of the mailpiece envelope to cut the top edge thereof during the second mailpiece processing operation.

16. The mailing machine according to claim 15 further comprising:

a diverter assembly adapted to direct the mailpiece envelopes over the moistening module/assembly and guide the mailpieces to the cutting blade assembly during the second mailpiece processing operation.

* * * * *